US010198925B2

(12) United States Patent
Stricker et al.

(10) Patent No.: US 10,198,925 B2
(45) Date of Patent: Feb. 5, 2019

(54) HOME AUTOMATION COMMUNICATION SYSTEM

(71) Applicant: Vivint, Inc., Provo, UT (US)

(72) Inventors: Jimmy Stricker, Herriman, UT (US); Craig Matsuura, Draper, UT (US); Ryan Carlson, South Jordan, UT (US); John Vogelsberg, West Jordan, UT (US); Michael Allen Tupy, Farmington, MN (US); Matthew Mahar, Salt Lake City, UT (US); Matthew J. Eyring, Provo, UT (US); Clint Gordon-Carroll, Orem, UT (US); Jeremy B. Warren, Draper, UT (US); James Ellis Nye, Alpine, UT (US); Jefferson Lyman, Alpine, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 15/483,906

(22) Filed: Apr. 10, 2017

(65) Prior Publication Data

US 2017/0278369 A1 Sep. 28, 2017

Related U.S. Application Data

(63) Continuation of application No. 14/681,363, filed on Apr. 8, 2015, now Pat. No. 9,619,985.

(51) Int. Cl.

| | |
|---|---|
| ***G08B 21/02*** | (2006.01) |
| ***G08B 21/22*** | (2006.01) |
| ***G08B 3/10*** | (2006.01) |
| ***G08B 25/08*** | (2006.01) |

(52) U.S. Cl.
CPC ..... *G08B 21/02* (2013.01); *G08B 3/10* (2013.01); *G08B 21/22* (2013.01); *G08B 25/08* (2013.01)

(58) Field of Classification Search
CPC ..... G08B 21/02; G08B 3/10; G08B 21/22; G08B 13/22
See application file for complete search history.

(56) References Cited

U.S. PATENT DOCUMENTS

| | | | | |
|---|---|---|---|---|
| 5,736,927 | A | 4/1998 | Stebbins et al. | |
| 5,889,468 | A | 3/1999 | Banga | |
| 6,175,307 | B1 | 1/2001 | Peterson | |
| 7,158,026 | B2 | 1/2007 | Feldkamp et al. | |
| 7,642,909 | B2 | 1/2010 | Acar | |
| 8,207,845 | B2 | 6/2012 | Sharma et al. | |
| 8,830,059 | B2 | 9/2014 | Nikolovski | |
| 2001/0029585 | A1 | 10/2001 | Simon et al. | |
| 2003/0017821 | A1 | 1/2003 | Irvin | |
| 2005/0007223 | A1 | 1/2005 | Schulze | |
| 2005/0046571 | A1 | 3/2005 | Stigall | |
| 2005/0273333 | A1 | 12/2005 | Morin et al. | |
| 2006/0107298 | A1* | 5/2006 | Friar | G08B 13/1672 725/108 |
| 2007/0182543 | A1 | 8/2007 | Luo | |

(Continued)

*Primary Examiner* — Erin F Heard
(74) *Attorney, Agent, or Firm* — Holland & Hart, LLP

(57) ABSTRACT

A method for security and/or automation systems is described. In one embodiment, the method may include receiving occupancy data associated with a home. The method may further include automatically selectively broadcasting an audio stream to at least one of a plurality of speakers in the home based, at least in part, on the received occupancy data.

18 Claims, 8 Drawing Sheets

(56) References Cited

U.S. PATENT DOCUMENTS

2007/0222578 A1* 9/2007 Iwamura ..... G08B 25/04 340/538
2007/0296575 A1 12/2007 Eisold et al.
2008/0079563 A1 4/2008 Crisafulli
2008/0197999 A1* 8/2008 Henderson ..... G08B 17/125 340/521
2008/0198006 A1* 8/2008 Chou ..... G07C 9/00158 340/540
2009/0058630 A1* 3/2009 Friar ..... G08B 25/08 340/506
2009/0072988 A1 3/2009 Haywood
2009/0323904 A1 12/2009 Shapiro et al.
2010/0097210 A1 4/2010 Tyroler et al.
2010/0117849 A1* 5/2010 Clayton ..... G06F 21/554 340/691.6
2010/0215154 A1* 8/2010 Bell ..... G08B 25/08 379/49
2010/0316237 A1 12/2010 Elberbaum
2011/0032095 A1 2/2011 Hicks, III
2013/0063263 A1 3/2013 Di Marco et al.
2013/0072251 A1 3/2013 Kim et al.
2013/0113928 A1 5/2013 Feldman
2013/0245796 A1 9/2013 Lentzitzky et al.
2014/0118140 A1* 5/2014 Amis ..... G08B 25/08 340/539.13
2014/0266669 A1 9/2014 Fadell et al.
2015/0370615 A1* 12/2015 Pi-Sunyer ..... G05B 15/02 700/276
2016/0065653 A1* 3/2016 Chen ..... H04L 67/10 715/735
2016/0116343 A1* 4/2016 Dixon ..... G01J 1/44 250/342
2016/0247364 A1* 8/2016 Herman ..... G08B 3/10
2017/0098351 A1* 4/2017 Modi ..... G08B 13/08
2018/0006758 A1* 1/2018 Filson ..... H04W 24/00

* cited by examiner

HOME AUTOMATION COMMUNICATION SYSTEM

CROSS-REFERENCE TO RELATED APPLICATIONS

The present Application is a continuation of U.S. patent application Ser. No. 14/681,363, titled: "Home Automation Communication System," filed on Apr. 8, 2015. The disclosure of which is incorporated by reference herein in its entirety.

BACKGROUND

The present disclosure, for example, relates to security and/or automation systems, and more particularly to automatically selectively broadcasting an audio stream to at least one of a plurality of speakers in a home based, at least in part, on detected occupancy data in the home.

Security and automation systems are widely deployed to provide various types of communication and functional features such as monitoring, communication, notification, and/or others. These systems may be capable of supporting communication with a user through a communication connection or a system management action.

Typical home security systems allow for an operator at a central security operating station to contact a homeowner via the home's primary security control panel in the case of an emergency. For example, if a perimeter alarm is triggered, an operator at the central security operating station may call the homeowner over the security panel to ask whether an emergency exists for which assistance is needed, or whether the alarm was set off accidentally. The homeowner may then reply to the operator via a microphone in the security panel to request assistance or explain that the alarm was set off in error. However, in most homes, the home security panel is located next to the garage door or front door of the home, and the homeowner may not be able to hear transmissions received over the speakers of the security panel from all areas of his home. Similarly, the operator may not be able to hear responses from homeowners who are not speaking directly into the security panel, or who may be located in another room or another part of the house.

Similarly, third parties attempting to contact users in the home may only be able to call the homeowners' cellular or landline phones, which may or may not be located with the homeowner at the time of the call. Where homeowners or occupants are not near their phones at the time of the call, the third parties may be unable to reach the intended recipients of their calls.

SUMMARY

Existing home security systems primarily comprise a single home security panel, usually located at the home's garage door or front door, into which a homeowner may enter his security code for arming and disarming the system and from which he may receive relevant home security information. Many home security panels also include a microphone and a speaker, such that the homeowner may communicate with operators at a central security operating station linked to the homeowner's home security system. In case of emergency or alarm activation, the security panel may act as an intercom to allow the operator to contact the homeowner over a broadband channel or other wireless connection to request information regarding the source of the alarm and any emergency assistance needed by the homeowner. While some homes may have more than one security panel, typical home security systems only provide a single microphone and speaker set, located at the primary home security panel. Thus, when an operator attempts to contact a homeowner, the operator is limited to communicating with the homeowner via the designated primary panel. If the homeowner is not near the primary home security panel at the time of the attempted communication, the operator may be unable to contact the homeowner in cases of emergency.

Even in existing systems in which an operator at a central security operating station may contact a homeowner via more than one microphone and speaker set, the likelihood of successfully initiating one- or two-way communication with the homeowner is slim without first knowing the homeowner's location in the home. In the meantime, valuable time may be wasted attempting to establish communication in the event of an emergency.

Similarly, existing user communication means, such as landline phone calls, cellular phone calls, video calls, and the like require the third party caller to know or guess at the recipient's location with respect to the communication device. If a potential recipient has left his cellular phone in his car when he enters his home, has switched the home phone to silent, or is in a different room from his computer, for example, the third party may be unsuccessful in his attempts to reach the intended recipient.

Accordingly, in one embodiment, a method for security and/or automation systems is provided. In one embodiment, the method may comprise receiving occupancy data associated with a home. The method may further comprise automatically selectively broadcasting audio to at least one of a plurality of speakers in the home based, at least in part, on the received occupancy data.

One aspect of the invention relates to systems and methods for providing a plurality of microphone and speaker systems throughout the home to allow for improved communication between homeowners and central security operating station operators or third party callers. A home automation system may monitor home occupancy data, such that, upon receiving a communication request from a third party caller or security system operator, the home automation system may automatically selectively broadcast the incoming call to the one or more microphone and/or speaker systems positioned most closely to the identified occupant (s). Similarly, the home automation system may allow for automatically targeted audio detection at the microphone systems positioned most closely to the identified occupants (s), such that the third party caller or security system operator may readily hear the occupants. In some cases, the microphones and speakers may be provided in secondary home security panels distributed throughout the home. Alternatively or in addition, microphones and/or speakers may be provided as components of other existing home automation systems, such as door bells, door cameras, thermostats or control panels, or other sensing systems located in various rooms throughout the home.

Room occupancy may be detected by any one or more of a video camera, audio sensor, motion sensor, vibration sensor, heart rate detector, respiration detector, or the like. In some embodiments, communications from the operator or third party caller may be broadcasted to the speaker/microphone systems located in those rooms in which motion was last detected. As the motion detectors or camera systems may be positioned separately from the microphone/speaker systems, the communication from the operator or third party caller may be selectively broadcasted to the microphone/ speaker system located closest to the motion detector or camera picking up occupancy data.

In some embodiments, when a central security operating station operator receives an alert from a home indicating that an alarm, such as a security alarm or smoke alarm, has been triggered, the operator may be presented with a list (or in some embodiments, a floor plan) including locations of each of the microphone and/or speaker systems in the home. In this way, the operator may selectively manually broadcast communications to the one or more speaker systems, rather than the communication being automatically broadcasted by the home automation system. In some embodiments, the operator may broadcast a communication to all operable speaker systems throughout the home. In alternate embodiments, the operator may selectively choose the speaker system through which to broadcast the communication, or in still other embodiments, the operator may toggle through all available speaker systems.

Similarly, in some embodiments, a third party caller may receive occupancy data associated with the home, and may selectively broadcast an audio stream, or attempt to establish two-way communication, with the speaker system positioned most closely to the identified occupant(s). In other embodiments, the third party may broadcast his communication to all available speaker systems, or may toggle through all available speaker systems.

In some embodiments, a homeowner who is away from home may establish one-way video monitoring with his home when the home is unoccupied. For example, the homeowner may access live video feeds from various rooms in his home from a dedicated application on his smartphone in order to monitor the status of his home and belongings or pets. In this way, a homeowner may be able to visualize potential threats or disasters in his home, should they occur.

The operator or third party caller may also listen to all available microphone systems in the home, or alternatively may selectively choose a microphone system, or alternatively still may toggle through the available microphone systems in order to locate the homeowner in the home and initiate a one- or two-way communication via the appropriate speaker/microphone system. In this way, the operator or third party caller may locate one or more homeowner based on detected audio in addition to or as an alternative to detected occupancy data by listening for a homeowner speaking, or in emergency situations, calling for help, from locations throughout the home in its entirety in order to locate the microphone positioned most closely to the homeowner. The operator or third party caller may then utilize the speaker system located most closely to the homeowner in order to communicate with the homeowner. In other embodiments, audio may be detected automatically from select microphones in the home based on occupancy data received at the home automation system.

In some embodiments, the home automation system may automatically choose, or in other embodiments the operator or third party caller may selectively choose, speaker systems through which to broadcast communications based on time stamped audio data received from the microphones positioned throughout the home. In other embodiments, the home automation system, or alternatively the operator or third party caller, may gather audio data associated with measured decibel levels, or may rely upon occupancy pattern recognition. For example, the home automation system may note from collected occupancy data that the homeowner is typically in his bedroom between 11:00 pm and 6:00 am, such that, if a communication is received during that time from an operator or third party caller, the home automation system may target communication to speakers located in the homeowner's bedroom.

In some embodiments the operator may have a floor plan of the homeowner's house, such that the operator may view the location of the plurality of speakers, microphones, motion detectors, and/or video cameras. Using the floor plan and microphone/speaker location information, the operator may selectively communicate with the homeowner based on the homeowner's detected location. Additionally, the operator may be able to provide specific floor plan and homeowner location information to the police or firefighters should emergency assistance be needed. In some embodiments, the floor plan may be updated in real time to display updated locations of occupants based on where sensors are tripping.

In still other embodiments, existing mobile robotic platforms, for example an iRobot Roomba®, may be retrofitted with an intercom system such that the robot may serve as a mobile intercom. The home automation system, the operator at the central security operating station, or the third party caller may send an action instruction to the robot to relocate to particular rooms in the home in order to locate the homeowner and allow for communication between the caller and the homeowner. Alternatively or in addition, the robot may be used to establish a floor plan for use by the operator in determining communication locations.

In some embodiments, audio other than voice communications, such as alarms or chimes, may also be broadcasted either to all operative speaker systems throughout the home, or selectively to particular speaker systems. For example, a doorbell chime may be broadcasted to all operable speaker systems throughout the home, or to only those rooms which are occupied. Alternatively, the doorbell chime may be broadcasted only to those rooms in which active occupant motion is detected, such that the chime is not heard in rooms in which occupants may be sleeping. Alternatively, a smoke alarm set off in one room may be broadcasted to all other rooms having speaker systems in the home. In this way, homeowners may receive important home security alerts automatically based on occupancy data detected at the home automation system, regardless of their location with respect to their primary security control panel.

The foregoing has outlined rather broadly the features and technical advantages of examples according to this disclosure so that the following detailed description may be better understood. Additional features and advantages will be described below. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein—including their organization and method of operation—together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Further, various components of the same type may be distinguished by following a first reference label with a dash and a second label that may distinguish among the similar components. However, features discussed for various components—including those having a dash and a second reference label—apply to other similar components. If only the first reference label is used in the specification, the description is applicable to any one of the similar components having the same first reference label irrespective of the second reference label.

DETAILED DESCRIPTION

The systems and methods described herein relate to facilitating outside caller communication with a plurality of microphones and speakers located throughout a home or property. More specifically, the systems and methods provided herein provide a means to selectively broadcast audio to at least one of the plurality of speakers in the home based, at least in part, on occupancy data detected in the home.

The following description provides examples and is not limiting of the scope, applicability, and/or examples set forth in the claims. Changes may be made in the function and/or arrangement of elements discussed without departing from the scope of the disclosure. Various examples may omit, substitute, and/or add various procedures and/or components as appropriate. For instance, the methods described may be performed in an order different from that described, and/or various steps may be added, omitted, and/or combined. Also, features described with respect to some examples may be combined in other examples.

Figure 1:
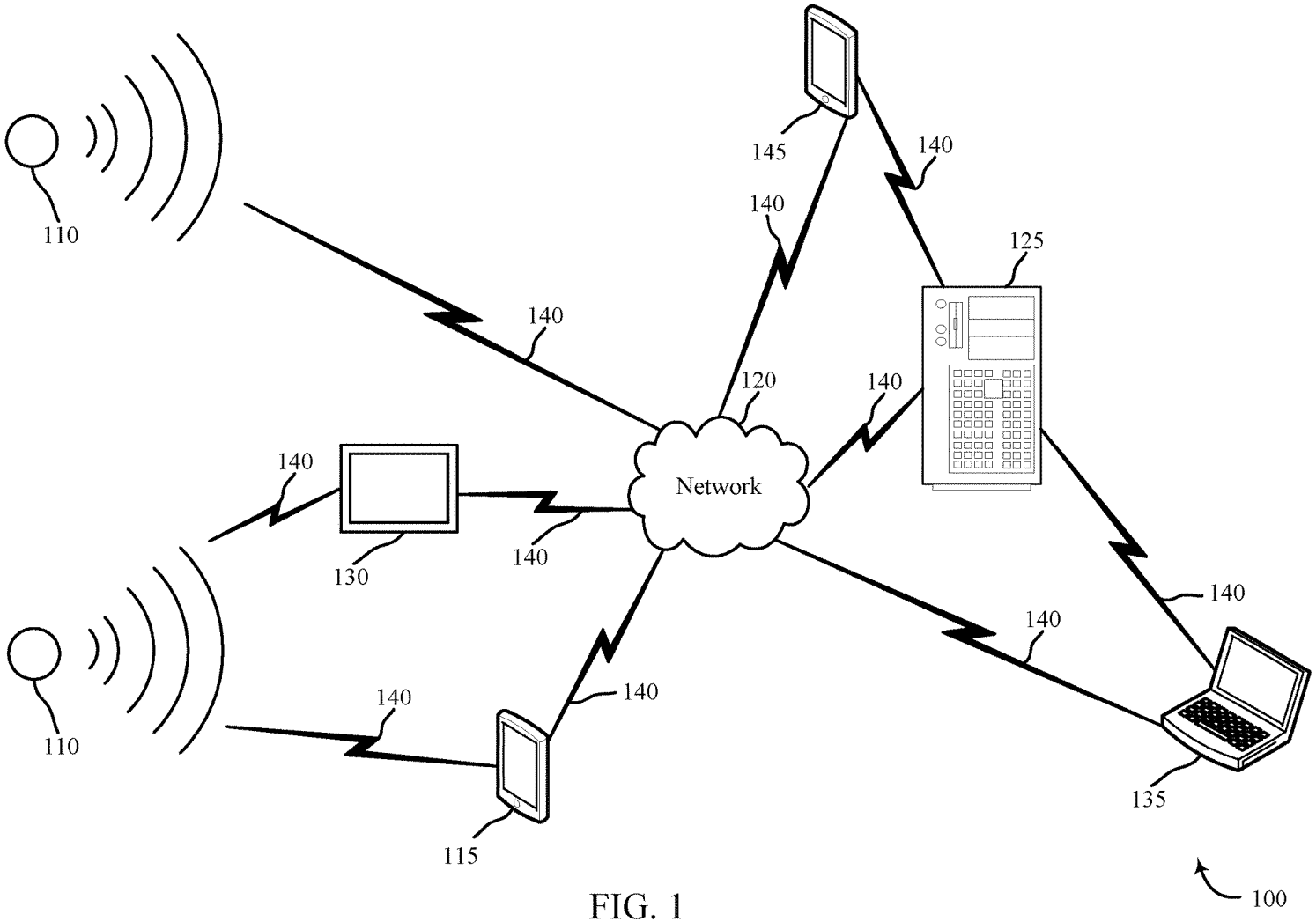
FIG. 1 is a block diagram of an example of a security and/or automation system, in accordance with various embodiments.

FIG. 1 is an example of a home automation system 100 in accordance with various aspects of the disclosure. In some embodiments, the home automation system 100 may include one or more sensor units 110, local computing device 115, network 120, server 125, control panel 130, and remote computing device 135, 145. The network 120 may provide user authentication, encryption, access authorization, tracking, Internet Protocol (IP) connectivity, and other access, calculation, modification, and/or functions. The control panel 130 may interface with the network 120 through wired and/or wireless communication links 140 and may perform communication configuration, adjustment, and/or scheduling for communication with local computing device 115 or remote computing device 135, 145, or may operate under the control of a controller. Control panel 130 may communicate with a back end server 125—directly and/or indirectly—using one or more communication links 140.

The control panel 130 may wirelessly communicate via communication links 140 with the local computing device 115 via one or more antennas. The control panel 130 may provide communication coverage for a geographic coverage area. In some examples, control panel 130 may be referred to as a control device, a base transceiver station, a radio base station, an access point, a radio transceiver, a home automation control panel, a smart home panel, a security control panel, or some other suitable terminology. The geographic coverage area for control panel 130 may be divided into sectors making up only a portion of the coverage area. Therefore, home automation system 100 may comprise more than one control panel 130, where each control panel 130 may provide geographic coverage for a sector of the coverage area. The home automation system 100 may include one or more control panels 130 of different types. The control panel 130 may be related to one or more discrete structures (e.g., a home, a business) and each of the one more discrete structures may be related to one or more discrete areas. Control panel 130 may be a home automation system control panel or security control panel, for example an interactive panel mounted on a wall in a user's home. Control panel 130 may be in direct communication via wired or wireless communication links 140 with the one or more sensor units 110, or may receive sensor data from the one or more sensor units 110 via local computing device 115 and network 120, or may receive data via remote computing device 135, 145, server 125, and network 120.

In any embodiment, control panel 130 may comprise any of a speaker, a microphone, or a combination thereof, described in more detail below with respect to FIG. 2. The control panel 130 may be operable to broadcast audio communications from the remote computing device 135, 145, or to detect audio input at the control panel 130 and communicate the audio to the remote computing device 135, 145, or a combination thereof. In other embodiments, control panel 130 may be operable to receive audio input and/or occupancy data from one or more sensor units 110 and transmit the audio input and/or occupancy data to remote computing device 135, 145, or to broadcast audio communications from the remote computing device 135, 145 to the one or more sensor units 110, or a combination thereof. In still other embodiments, control panel 130 may be operable to receive audio input and/or occupancy data from local computing device 115 and transmit the audio input and/or occupancy data to remote computing device 135, 145, or to broadcast audio communications from the remote computing device 135, 145 to the local computing device 115, or a combination thereof. In some embodiments, control panel 130 may communicate received occupancy data to a server 125 for processing.

The home automation system may comprise one or more local computing devices 115, which may be dispersed throughout the home automation system 100, where each device 115 may be stationary and/or mobile. Local computing device 115 may be a custom computing entity configured to interact with one or more sensor units 110 or control panel 130 via network 120, and in some embodiments, via server 125. In other embodiments, local computing device 115 may be a general purpose computing entity. A device 115 may include a cellular phone, a personal digital assistant (PDA), a wireless modem, a wireless communication device, a handheld device, a tablet computer, a laptop computer, a cordless phone, a wireless local loop (WLL) station, a display device (e.g., TVs, computer monitors, etc.), a printer, a sensor, and/or the like. A device 115 may also include or be referred to by those skilled in the art as a user device, a sensor, a smartphone, an iPod®, an iPad®, a Bluetooth device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology.

A local computing device 115, one or more sensor units 110, and/or control panel 130 may include and/or be one or more sensors that sense occupancy- and security-related data, including but not limited to: proximity, motion, temperatures, humidity, sound level, smoke, structural features (e.g., glass breaking, window position, door position), time, geo-location data of a user and/or a device, distance, biometrics, weight, speed, height, size, preferences, light, darkness, weather, time, system performance, vibration, respiration, heartbeat, and/or other inputs that relate to a security and/or an automation system. Furthermore, local computing device 115, one or more sensor units 110, and/or control panel 130 may comprise a speaker and/or microphone audio component. A local computing device 115 may be able to communicate through one or more wired and/or wireless communication links 140 with various components such as control panels, base stations, and/or network equipment (e.g., servers, wireless communication points, etc.) and/or the like.

Remote computing device 135, 145 may be, in some embodiments, a central security operating station, where the central security operating station is configured to monitor security data for the home automation system. An operator or dispatcher located at the central security operating station may receive security alerts and alarms from the home automation system and may attempt to establish one- or two-way communication with occupants in the home via the home automation system. In other embodiments, remote computing device 135, 145 may be a personal computing device, such as a smartphone, tablet, or personal computer, which a third party user may use to establish one- or two-way communication with occupants in the home. For example, a third party user may attempt to call his family from his smartphone when he is travelling, and may do so via the home automation system.

The communication links 140 shown in home automation system 100 may include uplink (UL) transmissions from a local computing device 115 to a control panel 130, and/or downlink (DL) transmissions from a control panel 130 to a local computing device 115. The communication links 140 may further or alternatively include uplink (UL) transmissions from a local computing device 115, one or more sensor units 110, and/or control panel 130 to remote computing device 135, 145, and/or downlink (DL) transmissions from the remote computing device 135, 145 to local computing device 115, one or more sensor units 110, and/or control panel 130. The downlink transmissions may also be called forward link transmissions while the uplink transmissions may also be called reverse link transmissions. Each communication link 140 may include one or more carriers, where each carrier may be a signal made up of multiple sub-carriers (e.g., waveform signals of different frequencies) modulated according to the various radio technologies. Each modulated signal may be sent on a different sub-carrier and may carry control information (e.g., reference signals, control channels, etc.), overhead information, user data, etc. The communication links 140 may transmit bidirectional communications and/or unidirectional communications. Communication links 140 may include one or more connections, including but not limited to, 345 MHz, Wi-Fi, Bluetooth, cellular, Z Wave, 802.11, peer-to-peer, LAN, WLAN, Ethernet, fire wire, fiber optic, and/or other connection types related to security and/or automation systems.

In some embodiments of home automation system 100, control panel 130, one or more sensor units 110, and/or local computing device 115 may include one or more antennas for employing antenna diversity schemes to improve communication quality and reliability between control panel 130, one or more sensor units 110, and local computing device 115. Additionally or alternatively, control panel 130, one or more sensor units 110, and/or local computing device 115 may employ multiple-input, multiple-output (MIMO) techniques that may take advantage of multi-path, mesh-type environments to transmit multiple spatial layers carrying the same or different coded data.

Local computing device 115 may communicate directly with one or more other devices via one or more direct communication links 140. Two or more local computing devices 115 may communicate via a direct communication link 140 when both devices 115 are in the geographic coverage area or when one or neither devices 115 is within the geographic coverage area. Examples of direct communication links 140 may include Wi-Fi Direct, Bluetooth, wired, and/or other P2P group connections. The devices 115 in these examples may communicate according to the WLAN radio and baseband protocol including physical and MAC layers from IEEE 802.11, and its various versions including, but not limited to, 802.11b, 802.11g, 802.11a, 802.11n, 802.11ac, 802.11ad, 802.11ah, etc. In other implementations, other peer-to-peer connections and/or ad hoc networks may be implemented within home automation system 100.

In some embodiments, one or more sensor units 110 may communicate via wired or wireless communication links 140 with one or more of the local computing device 115 or network 120. The network 120 may communicate via wired or wireless communication links 140 with the control panel 130 and the remote computing device 135, 145 via server 125. In alternate embodiments, the network 120 may be integrated with any one of the local computing device 115, server 125, or remote computing device 135, 145, such that separate components are not required. Additionally, in alternate embodiments, one or more sensor units 110 may be integrated with control panel 130, and/or control panel 130 may be integrated with local computing device 115, such that separate components are not required.

The local computing device 115 and/or control panel 130 may include memory, a processor, an output, a data input and a communication module. The processor may be a general purpose processor, a Field Programmable Gate Array (FPGA), an Application Specific Integrated Circuit (ASIC), a Digital Signal Processor (DSP), and/or the like. The processor may be configured to retrieve data from and/or write data to the memory. The memory may be, for example, a random access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some embodiments, the local computing device 115 and/or control panel 130 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, receiving and displaying data from one or more sensor units 110.

The processor of the local computing device 115 and/or control panel 130 may be operable to control operation of the output of the local computing device 115 and/or control panel 130. The output may be a television, a liquid crystal display (LCD) monitor, a cathode ray tube (CRT) monitor, speaker, tactile output device, and/or the like. In some embodiments, the output may be an integral component of the local computing device 115. Similarly stated, the output may be directly coupled to the processor. For example, the output may be the integral display of a tablet and/or smartphone. In some embodiments, an output module may include, for example, a High Definition Multimedia Interface™ (HDMI) connector, a Video Graphics Array (VGA) connector, a Universal Serial Bus™ (USB) connector, a tip, ring, sleeve (TRS) connector, and/or any other suitable connector operable to couple the local computing device 115 and/or control panel 130 to the output.

The remote computing device 135, 145 may be a computing entity operable to enable a remote user or operator to establish one- or two-way communication with one or more of the control panel 130, local computing device 115, and/or one or more sensor units 110. The remote computing device 135, 145 may be functionally and/or structurally similar to the local computing device 115 and may be operable to receive data streams from and/or send signals to at least one of the sensor units 110, control panel 130, and/or local computing device 115, via the network 120. The network 120 may be the Internet, an intranet, a personal area network, a local area network (LAN), a wide area network (WAN), a virtual network, a telecommunications network implemented as a wired network and/or wireless network, etc. The remote computing device 135, 145 may receive and/or send signals over the network 120 via communication links 140 and server 125.

In some embodiments, the one or more sensor units 110, control panel 130, and/or local computing device 115 may be sensors configured to conduct periodic or ongoing automatic measurements related to occupancy and/or audio input. Each sensor unit 110, control panel 130, and/or local computing device 115 may be capable of sensing multiple parameters, or alternatively, separate sensor units 110, control panels 130, and/or local computing devices 115 may monitor separate parameters. For example, one sensor unit 110 may measure occupancy using motion sensors, while a control panel 130 (or, in some embodiments, the same or a different sensor unit 110) may detect audio input, for example from a user speaking or calling for help. In some embodiments, a local computing device 115 may additionally monitor alternate occupancy parameters, such as using heartbeat or breathing sensors. In alternate embodiments, a user may input occupancy data directly at the local computing device 115 or control panel 130. For example, a user may enter occupancy data into a dedicated application on his smartphone indicating that he is in the living room of his home, and that occupancy data may be communicated to the remote computing device 135, 145 accordingly. Alternatively or in addition, a GPS feature integrated with the dedicated application on the user's smartphone may communicate the user's occupancy or location data to the remote computing device 135, 145.

In some embodiments, the one or more sensor units 110 may be separate from the control panel 130, and may be positioned at various locations throughout the home or property. In other embodiments, the one or more sensor units 110 may be integrated or collocated with home automation system components or home appliances or fixtures. For example, a sensor unit 110 may be integrated with a doorbell system, or may be integrated with a front porch light. In other embodiments, a sensor unit 110 may be integrated with a wall outlet or switch. In still other embodiments, the one or more sensor units 110 may be integrated or collocated with the control panel 130 itself. In any embodiment, each of the one or more sensor units 110, control panel 130, and/or local computing device 115 may comprise a speaker unit, a microphone unit, or a combination thereof.

In some embodiments, sensor units 110 may comprise sensor modules retrofitted to existing mobile robotic device platforms, for example an iRobot Roomba®. The sensor units 110 integrated with or attached to the mobile robotic device may therefore be mobile throughout the home or property to detect audio and/or occupancy data, or to broadcast audio from the remote computing device 135, 145, or a combination thereof. The mobile robotic devices may be operable to locate users in the home based on motion detection, sound detection, heartbeat or breathing detection, or any other known means. Alternatively or in addition, the mobile robotic devices may be operable to relocate to users in the home based on instructions received from a component of the home automation system or the remote computing device 135, 145. In this way, one- and two-way communication may be established between the remote computing device 135, 145 and users in the home, regardless of the location of stationary sensor units 110 or control panels 130.

Audio and/or occupancy data gathered by the one or more sensor units 110 may be communicated to local computing device 115, which may be, in some embodiments, a thermostat, control panel, or other wall-mounted input/output home automation system display. In other embodiments, local computing device 115 may be a personal computer or smartphone. Where local computing device 115 is a smartphone, the smartphone may have a dedicated application directed to collecting user occupancy and audio data and facilitating one- and two-way communication with outside callers. The local computing device 115 may communicate the received occupancy and/or audio data to the remote computing device 135, 145. In other embodiments, audio and/or occupancy data collected by the one or more sensor units 110 may be communicated to the control panel 130, which may communicate the collected audio and/or occupancy data to the remote computing device 135, 145. In still other embodiments, audio and/or occupancy data collected by the one or more sensor units 110 may be communicated directly to the remote computing device 135, 145 via network 120, and in some embodiments, additionally through remote server 125. Data transmission may occur via, for example, frequencies appropriate for a personal area network (such as Bluetooth or IR communications) or local or wide area network frequencies such as radio frequencies specified by the IEEE 802.15.4 standard.

In addition, audio may be broadcasted from the remote computing device 135, 145 to any of the one or more sensor units 110, local computing device 115, or control panel 130, or a combination thereof. The broadcasted audio may be communicated directly to the one or more sensor units 110, local computing device 115, or control panel 130 via network 120, or may first be communicated to remote server 125. In addition, audio broadcasts communicated to one or more sensor units 110 from remote computing device 135, 145 may first be communicated via network 120 to control panel 130 and/or local computing device 115.

In some embodiments, one or more sensor units 110, local computing device 115, or control panel 130 may communicate with remote computing device 135, 145 via network 120 and server 125. Examples of networks 120 include cloud networks, local area networks (LAN), wide area networks (WAN), virtual private networks (VPN), wireless networks (using 802.11, for example), and/or cellular networks (using 3G and/or LTE, for example), etc. In some configurations, the network 120 may include the Internet.

The server 125 may be configured to communicate with the sensor units 110, the local computing device 115, the remote computing device 135, 145, and control panel 130. The server 125 may perform additional processing on signals received from the one or more sensor units 110, control panel 130, or local computing device 115, or may simply forward the received information to the remote computing device 135, 145. For example, server 125 may receive occupancy data from one or more sensor units 110, and may receive a communication request from remote computing device 135. Based on the received occupancy data, the server 125 may direct the received communication request to the appropriate component of the home automation system, such as a control panel 130 or local computing device 115. In this way, the home automation system, via the server 125, may automatically direct incoming audio streams from an operator or third party caller to the appropriate microphone/speaker system in the home such that one- or two-way communication with the home occupants may be achieved.

Server 125 may be a computing device operable to receive data streams (e.g., from one or more sensor units 110, control panel 130, local computing device 115, and/or remote computing device 135, 145), store and/or process data, and/or transmit data and/or data summaries (e.g., to remote computing device 135, 145). For example, server 125 may receive a stream of occupancy data based on motion detected by a sensor unit 110, a stream of audio data from the same or a different sensor unit 110, and a stream of audio data from a control panel 130. In some embodiments, server 125 may "pull" the data streams, e.g., by querying the sensor units 110, the local computing device 115, and/or the control panel 130. In some embodiments, the data streams may be "pushed" from the sensor units 110, control panel 130, and/or the local computing device 115 to the server 125. For example, the sensor units 110, control panel 130, and/or the local computing device 115 may be configured to transmit data as it is generated by or entered into that device. In some instances, the sensor units 110, control panel 130, and/or the local computing device 115 may periodically transmit data (e.g., as a block of data or as one or more data points). In some embodiments, audio and/or occupancy data may only be transmitted to the remote computing device 135, 145 based on a triggered alarm event.

The server 125 may include a database (e.g., in memory) containing occupancy and/or audio data received from the one or more sensor units 110, control panel 130, and/or the local computing device 115. Additionally, as described in further detail herein, software (e.g., stored in memory) may be executed on a processor of the server 125. Such software (executed on the processor) may be operable to cause the server 125 to monitor, process, summarize, present, and/or send a signal associated with user occupancy and/or audio data.

Figure 2:
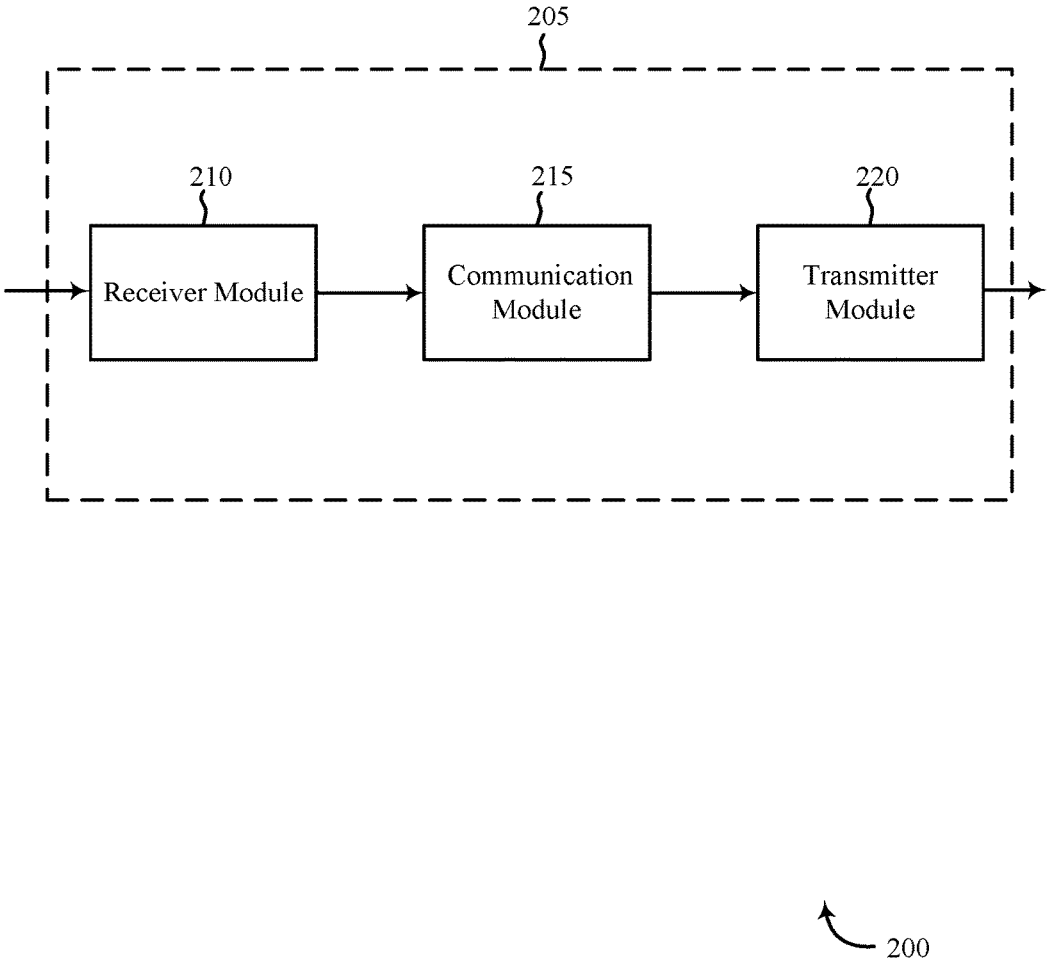
FIG. 2 shows a block diagram of a device relating to a security and/or an automation system, in accordance with various aspects of this disclosure.

FIG. 2 shows a block diagram 200 of an apparatus 205 for use in electronic communication, in accordance with various aspects of this disclosure. The apparatus 205 may be an example of one or more aspects of a control panel 130, or in other embodiments may be an example of one or more aspects of the one or more sensor units 110, or in still other embodiments may be an example of one or more aspects of the local computing device 115, each of which are described with reference to FIG. 1. The apparatus 205 may include any of a receiver module 210, a communication module 215, and/or a transmitter module 220. The apparatus 205 may also be or include a processor. Each of these modules may be in communication with each other—directly and/or indirectly.

As previously discussed, in some embodiments, where apparatus 205 is a control panel, apparatus 205 may be a control panel in the form of, for example, an interactive home automation system display. In other embodiments, apparatus 205 may be a local computing device, such as a personal computer or smartphone. In still other embodiments, apparatus 205 may be at least one sensor unit.

The components of the apparatus 205 may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

The receiver module 210 may receive information such as packets, user data, and/or control information associated with various information channels (e.g., control channels, data channels, etc.). The receiver module 210 may be configured to receive audio streams from the remote computing device, which may be a central security operating station in some embodiments, or may be a computing device operated by a third party caller in other embodiments. Received audio streams may be passed on to a communication module 215, which may project at the apparatus 205 audio streams received from the receiver module 210. In addition, the communication module 215 may detect audio and/or occupancy data at the apparatus 205, and may communicate the detected audio and/or occupancy data on to a transmitter module 220, and to other components of the apparatus 205. The transmitter module 220 may then communicate the occupancy and/or audio data to the remote computing device or to a local server.

In one embodiment, where the apparatus 205 is a control panel, the transmitter module 220 may communicate an alarm event to the remote computing device, for example a central security operating station, indicating that an alarm, such as a perimeter security alarm, has been triggered at the home. The transmitter module 220 may then communicate a "listen to follow" signal to the central security operating station, indicating to the central security operating station that the control panel is about to call the central security operating station. The transmitter module 220 may then initiate a call with the central security operating station. In some embodiments, the central security operating station may place the call from the control panel in a queue to be answered. Once the central security operating station has accepted the call from the control panel, the central security operating station may selectively initiate communication with any control panel, speaker system, or microphone system in the home. As discussed in more detail below with respect to FIG. 5, the selective communication by the central security operating station with at least one of a plurality of speakers in the home may be based, at least in part, on detected occupancy data of the home. The selective communication may occur automatically as a result of occupancy detection by the home automation system, or in other embodiments may occur manually at the central security operating station on the basis of received occupancy data.

Figure 3:
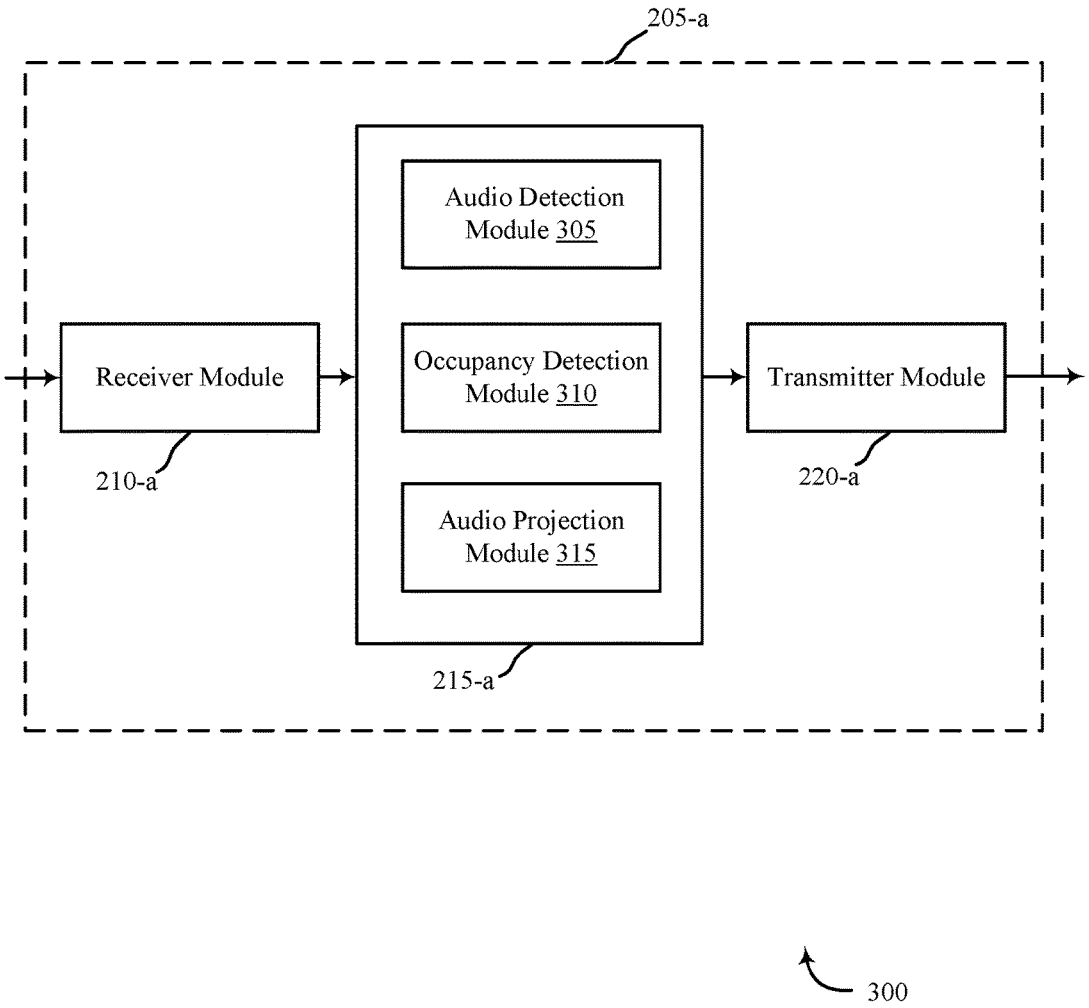
FIG. 3 shows a block diagram of a device relating to a security and/or an automation system, in accordance with various aspects of this disclosure.

Apparatus 205-*a*, which may be an example of apparatus 205 illustrated in FIG. 2, is further detailed in FIG. 3. Apparatus 205-*a* may comprise any of a receiver module 210-*a*, a communication module 215-*a*, and/or a transmitter module 220-*a*, each of which may be examples of the receiver module 210, the communication module 215, and the transmitter module 220 as illustrated in FIG. 2. Apparatus 205-*a* may further comprise, as a component of the communication module 215-*a*, any of an audio detection module 305, an occupancy detection module 310, and an audio projection module 315.

The components of apparatus 205-*a* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

Where apparatus 205-*a* is any of a sensor unit, control panel, or local computing device, receiver module 210-*a* may be operable to receive audio stream broadcasts from the remote computing device. Such audio stream broadcasts may be received in the form of verbal communications, or may be alarms, chimes, or other auditory signals. The received audio stream may then be communicated to audio projection module 315 in the communication module 215-*a*. The audio projection module 315 may project the audio stream via one or more speaker units integrated with the apparatus 205-*a*, or may communicate the audio stream to a remotely located speaker unit.

In addition, the same apparatus 205-*a* or a separate apparatus 205-*a* may be operable to detect audio at the apparatus 205-*a* via audio detection module 305. For example, apparatus 205-*a* may be operable to detect a user speaking near the apparatus 205-*a*, which may be any of a sensor unit, control panel, or local computing device. In other embodiments, audio detection module 305 may detect the audio output of a triggered alarm, such as a security alarm or smoke alarm, or may detect the sound of a user falling to the ground or crying for help. The audio detected by audio detection module 305 may be communicated to transmitter module 220-*a*, which may communicate the detected audio data to the remote computing device.

In addition, the same apparatus 205-*a* or a separate apparatus 205-*a* may be operable to detect user occupancy data at the apparatus 205-*a* via occupancy detection module 310. For example, the apparatus 205-*a* may comprise a motion sensor, heartbeat sensor, breathing sensor, vibration sensor, or any other known occupancy detection means, to detect the presence of a user at or near the apparatus 205-*a*. The collected occupancy data may then be communicated from occupancy detection module 310 to transmitter module 220-*a*, which may transmit the occupancy data to the processor and/or to the remote computing device. As previously discussed, where occupancy data is transmitted via transmitter module 220-*a* to a processor, the processor may accordingly broadcast audio streams received from the remote computing device to the appropriate apparatus 205-*a* according to the received occupancy data. In addition or alternatively, occupancy data transmitted via transmitter module 220-*a* to the remote computing device may be presented to the operator or third party caller, such that the caller may selectively broadcast an audio stream to the appropriate apparatus or speaker system(s) according to the received occupancy data. In this way, callers may reach home occupants immediately at the occupants' current location.

In some embodiments, audio and/or occupancy data may be detected continuously at apparatus 205-*a*, or at predetermined intervals. In other embodiments, audio and/or occupancy data may be detected at apparatus 205-*a* at the instruction of the remote computing device or the home automation system. In some embodiments, audio and/or occupancy data may be detected at apparatus 205-*a* only upon the triggering of an alarm event. In some embodiments, the collected audio and/or occupancy data may be communicated via transmitter module 220-*a* in real time to the processor or remote computing device, while in other embodiments, the collected audio and/or occupancy data may be time stamped and stored in a memory integrated with the apparatus 205-*a*, or in the network or remote server (as shown in FIG. 1).

Figure 4:
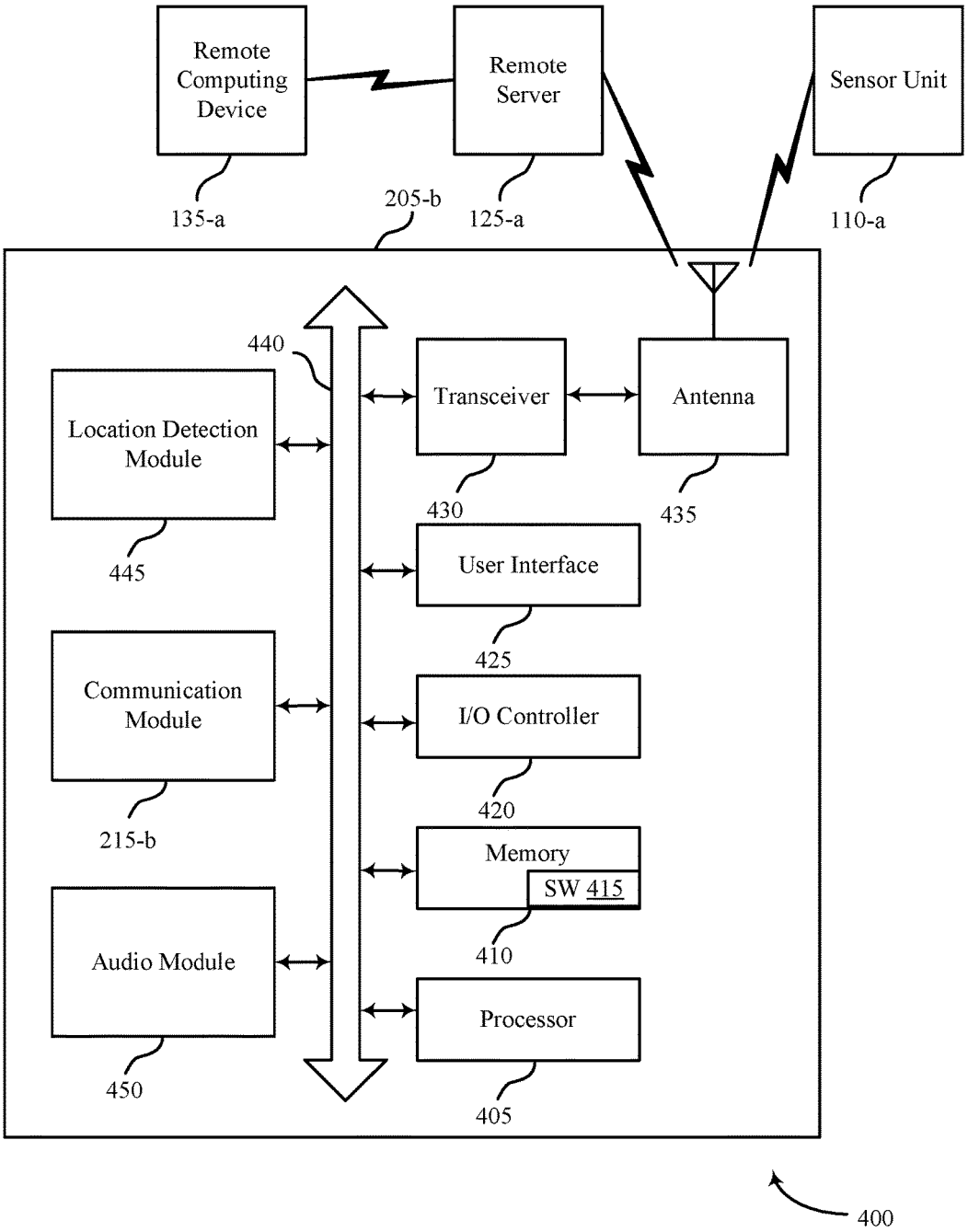
FIG. 4 shows a block diagram relating to a security and/or an automation system, in accordance with various aspects of this disclosure.

FIG. 4 shows a system 400 for use in establishing communication between a central security operating station or third party caller and occupants of a home, in accordance with various examples. System 400 may include an apparatus 205-*b*, which may be an example of the control panel 130, local computing device 115, and/or one or more sensor units 110 of FIG. 1. Apparatus 205-*b* may also be an example of one or more aspects of apparatus 205 and/or 205-*a* of FIGS. 2 and 3.

Apparatus 205-*b* may include a communication module 215-*b*, which may be an example of the communication module 215, 215-*a* described with reference to FIGS. 2 and 3. The communication module 215-*b* may detect and/or project audio, or may detect user occupancy, or a combination thereof, as described above with reference to FIGS. 2-3.

Apparatus 205-*b* may also include components for bi-directional voice and data communications including components for transmitting communications and components for receiving communications. For example, apparatus 205-*b* may communicate bi-directionally with one or more of remote computing device 135-*a*, remote server 125-*a*, or sensor unit 110-*a*. This bi-directional communication may be direct (e.g., apparatus 205-*b* communicating directly with sensor unit 110-*a*) or indirect (e.g., apparatus 205-*b* communicating with remote computing device 135-*a* via remote server 125-*a*). Remote server 125-*a*, remote computing device 135-*a*, and sensor unit 110-*a* may be examples of remote server 125, remote computing device 135, 145, and sensor unit 110 as shown with respect to FIG. 1.

In addition, apparatus 205-*b* may comprise location detection module 445 and audio module 450. Location detection module 445 may be operable to communicate the location of the apparatus 205-*b* to the remote computing device 135-*a* or remote server 125-*a*. Where apparatus 205-*b* may be any of a control panel, sensor unit, or local computing device, the plurality of apparatuses 205-*b* positioned throughout the home or property may communicate their respective location data via location detection module 445 such that the remote computing device 135-*a* or remote server 125-*a* may be presented with, for example, a list or map of apparatuses 205-*b* throughout the home or property. Based on this received data, an operator or third party caller may decide to, or the processor may automatically, selectively broadcast an audio stream to one or more apparatuses 205-*b* based on their respective locations throughout the home as compared with identified occupant locations.

In addition, audio module 450 may comprise a microphone or a speaker, or a combination thereof. Thus, the remote computing device 135-*a* may be able to establish one- or two-way communication with one or more apparatuses 205-*b* throughout the home or property based, at least in part, on the location of each apparatus 205-*b*. Further, using user occupancy data collected from communication module 215-*b*, the remote computing device 135-*a* may be able to establish one- or two-way communication with one or more apparatuses 205-*b* based, at least in part, on detected user occupancy. In some embodiments, one- or two-way communication may be established based on data received from more than one apparatus 205-*b*. For example, a first apparatus, such as the apparatus 205-*b*, may collect and communicate audio data via communication module 215-*b* to the remote computing device 135-*a*. However the first apparatus 205-*b* may not have a speaker and/or microphone unit. Thus, one- or two-way communication may be established between the remote computing device 135-*a* and a second apparatus located near the first apparatus 205-*b* based on location information received from the location detection modules 445 in each of the first and second apparatuses. In this way, one- or two-way communication may be established with the remote computing device 135-*a* via the apparatus having a speaker and/or microphone unit that is located most closely to the detected audio and/or user occupancy data.

Apparatus 205-*b* may also include a processor module 405, and memory 410 (including software (SW) 415), an input/output controller module 420, a user interface module 425, a transceiver module 430, and one or more antennas 435, each of which may communicate—directly or indirectly—with one another (e.g., via one or more buses 440). The transceiver module 430 may communicate bi-directionally—via the one or more antennas 435, wired links, and/or wireless links—with one or more networks or remote devices as described above. For example, the transceiver module 430 may communicate bi-directionally with one or more of remote server 125-*a* or sensor unit 110-*a*. The transceiver module 430 may include a modem to modulate the packets and provide the modulated packets to the one or more antennas 435 for transmission, and to demodulate packets received from the one or more antennas 435. While an apparatus comprising a sensor unit, local computing device, or control panel (e.g., 205-*b*) may include a single antenna 435, the apparatus may also have multiple antennas 435 capable of concurrently transmitting or receiving multiple wired and/or wireless transmissions. In some embodiments, one element of apparatus 205-*b* (e.g., one or more antennas 435, transceiver module 430, etc.) may provide a direct connection to a remote server 125-*a* via a direct network link to the Internet via a POP (point of presence). In some embodiments, one element of apparatus 205-*b* (e.g., one or more antennas 435, transceiver module 430, etc.) may provide a connection using wireless techniques, including digital cellular telephone connection, Cellular Digital Packet Data (CDPD) connection, digital satellite data connection, and/or another connection.

The signals associated with system 400 may include wireless communication signals such as radio frequency, electromagnetics, local area network (LAN), wide area network (WAN), virtual private network (VPN), wireless network (using 802.11, for example), 345 MHz, Z Wave, cellular network (using 3G and/or LTE, for example), and/or other signals. The one or more antennas 435 and/or transceiver module 430 may include or be related to, but are not limited to, WWAN (GSM, CDMA, and WCDMA), WLAN (including Bluetooth and Wi-Fi), WMAN (WiMAX), antennas for mobile communications, antennas for Wireless Personal Area Network (WPAN) applications (including RFID and UWB). In some embodiments each antenna 435 may receive signals or information specific and/or exclusive to itself. In other embodiments each antenna 435 may receive signals or information neither specific nor exclusive to itself.

In some embodiments, the user interface module 425 may include an audio device, such as an external speaker system, an external display device such as a display screen, and/or an input device (e.g., remote control device interfaced with the user interface module 425 directly and/or through I/O controller module 420).

One or more buses 440 may allow data communication between one or more elements of apparatus 205-*b* (e.g., processor module 405, memory 410, I/O controller module 420, user interface module 425, etc.).

The memory 410 may include random access memory (RAM), read only memory (ROM), flash RAM, and/or other types. The memory 410 may store computer-readable, computer-executable software/firmware code 415 including instructions that, when executed, cause the processor module 405 to perform various functions described in this disclosure (e.g., detect audio and/or occupancy data, broadcast audio communications from the remote computing device, etc.). Alternatively, the software/firmware code 415 may not be directly executable by the processor module 405 but may cause a computer (e.g., when compiled and executed) to perform functions described herein.

In some embodiments the processor module 405 may include, among other things, an intelligent hardware device (e.g., a central processing unit (CPU), a microcontroller, and/or an ASIC, etc.). The memory 410 may contain, among other things, the Basic Input-Output system (BIOS) which may control basic hardware and/or software operation such as the interaction with peripheral components or devices. For example, the communication module 215-*b* may be stored within the system memory 410. Applications resident with system 400 are generally stored on and accessed via a non-transitory computer readable medium, such as a hard disk drive or other storage medium. Additionally, applications may be in the form of electronic signals modulated in accordance with the application and data communication technology when accessed via a network interface (e.g., transceiver module 430, one or more antennas 435, etc.).

Many other devices and/or subsystems may be connected to, or may be included as, one or more elements of system 400 (e.g., entertainment system, computing device, remote cameras, wireless key fob, wall mounted user interface device, cell radio module, battery, alarm siren, door lock, lighting system, thermostat, home appliance monitor, utility equipment monitor, and so on). In some embodiments, all of the elements shown in FIG. 4 need not be present to practice the present systems and methods. The devices and subsystems can be interconnected in different ways from that shown in FIG. 4. In some embodiments, an aspect of some operation of a system, such as that shown in FIG. 4, may be readily known in the art and is not discussed in detail in this disclosure. Code to implement the present disclosure may be stored in a non-transitory computer-readable medium such as one or more of system memory 410 or other memory. The operating system provided on I/O controller module 420 may be iOS®, ANDROID®, MS-dOS®, MS-WINDOWS®, OS/2®, UNIX®, LINUX®, or another known operating system.

The components of the apparatus 205-*b* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented—in whole or in part—with instructions embodied in memory formatted to be executed by one or more general and/or application-specific processors.

Figure 5:
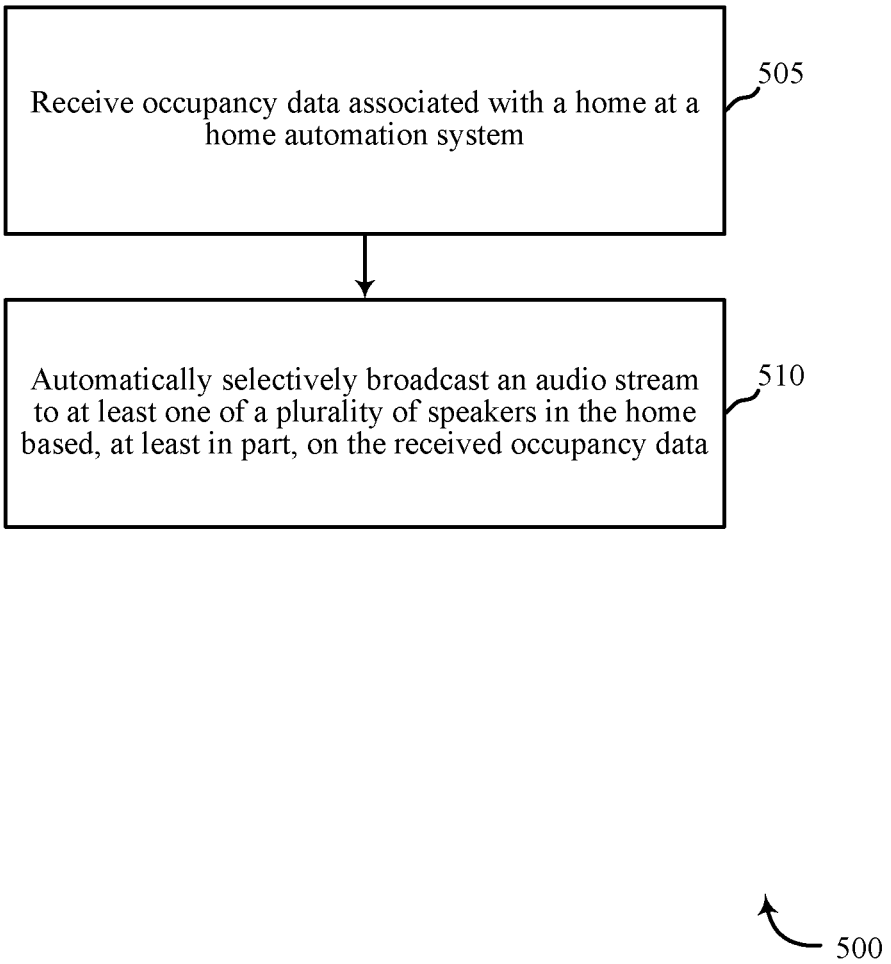
FIG. 5 is a flow chart illustrating an example of a method relating to a security and/or an automation system, in accordance with various aspects of this disclosure.

FIG. 5 is a flow chart illustrating an example of a method 500 for establishing communication between an operator at a central security operating station, or a third party caller, and a home. For clarity, the method 500 is described below with reference to aspects of one or more of the sensor units 110, local computing device 115, control panel 130, and/or remote computing device 135, 145 described with reference to FIGS. 1-4, and/or aspects of one or more of the apparatus 205, 205-*a*, or 205-*b* described with reference to FIGS. 2-4. In some examples, a control panel, local computing device, and/or sensor unit may execute one or more sets of codes to control the functional elements described below. Additionally or alternatively, the control panel, local computing device, and/or sensor unit may perform one or more of the functions described below using special-purpose hardware.

At block 505, the method 500 may include receiving occupancy data associated with a home at a home automation system. Occupancy may be detected by motion sensors, heartbeat or breathing sensors, vibration sensors, or any other known occupancy detection means. Occupancy may alternatively or in addition be manually inputted by a user at a local computing device such as a personal computer or smartphone, or may be automatically detected by a location sensor integrated with the local computing device or by a communication between the local computing device and another component of the home automation system. For example, occupancy data may be received at the home automation system indicating that there is movement in the kitchen, or that a smartphone signal is being detected in a bedroom. In some embodiments, detected occupancy and/or audio data may be communicated to a remote computing device, such as a central security operating station or a personal computing device of a third party caller, where the occupancy and/or audio data may be displayed, for example in the form of a list, or in the form of a map of the home or property. Detected occupancy and/or audio data may be continuously updated, or may be updated at predetermined intervals, or may alternatively be updated at the direction of the home automation system or remote computing device.

At block 510, the method 500 may include selectively broadcasting an audio stream to at least one of a plurality of speakers in the home based, at least in part, on the received occupancy data. Thus, one- or two-way communication may be selectively established between a remote computing device, such as an operator calling from a central security operating station or a third party calling from a smartphone or personal computer, and one or more speaker systems in the home based on identified locations of users. In this way, if a user is in distress or needs to communicate with the central security operating station, the user need not be positioned adjacent to the primary security control panel, usually located near a front door or garage door in a home. Rather, the central security operating station may establish communication with the user using any one or more apparatuses positioned near the user, as determined by the occupancy data, having a speaker unit. Similarly, a third party caller attempting to, for example, call his family at home while he is travelling, may initiate a call on his smartphone to the home automation system. Using received occupancy data detected by one or more sensor units, the home automation system may automatically selectively establish communication between the third party caller and the occupants of the home based on the occupants' determined location(s). Where occupancy is detected in more than one location in the home or property, the central security operating station or third party caller may selectively broadcast an audio stream to any location having a speaker unit that is positioned near the detected occupant(s), such that communication may be established with some or all occupants in the home. For example, where the home automation system determines that two occupants are located in the living room, while another occupant is located in the kitchen, the operator or third party caller may be presented with a list or map of speaker systems and detected occupant locations, and the caller may selectively broadcast audio to one or more speaker systems based on the detected occupant locations. In other embodiments, the home automation system may automatically broadcast the incoming audio stream to all of the speaker systems that are positioned near the detected occupants.

In some embodiments, one or more sensor units may employ facial recognition technology to identify the particular occupants in each location in the home. The identity information may be communicated, for example, to the third party caller such that the third party caller may selectively broadcast his communication to a targeted recipient. In other embodiments, the third party caller may identify at the remote computing device an intended recipient, and the home automation system may broadcast the caller's communication to the appropriate recipient automatically based on occupant identity and location information received from the one or more sensor units at the home automation system.

The operations at blocks 505 and 510 may be performed using the receiver module 210, 210-*a*, the communication module 215, 215-*a*, 215-*b*, the transmitter module 220, 220-*a*, and/or the transceiver module 430, described with reference to FIGS. 2-4.

Thus, the method 500 may provide for communication methods relating to automation/security systems. It should be noted that the method 500 is just one implementation and that the operations of the method 500 may be rearranged or otherwise modified such that other implementations are possible.

Figure 6:
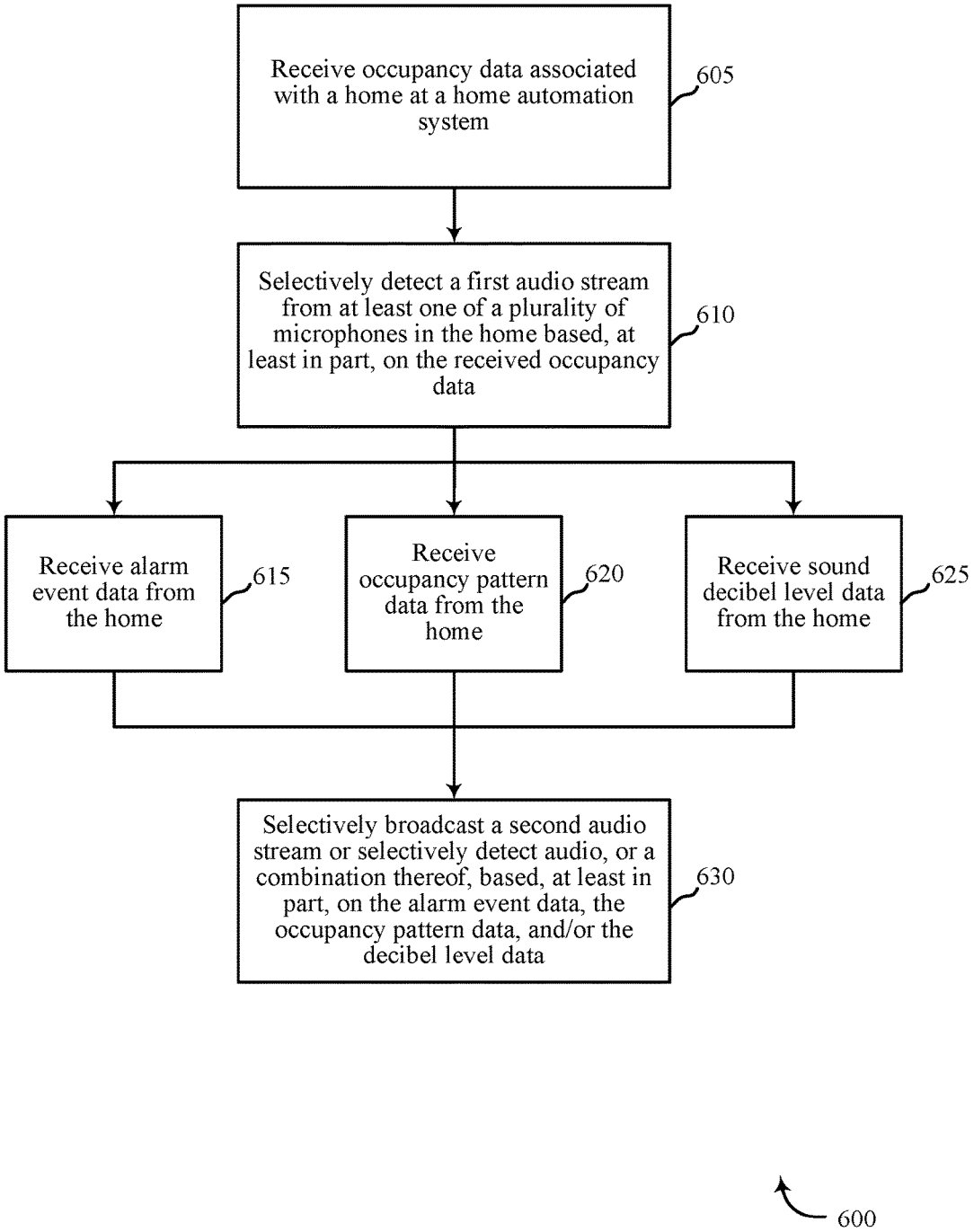
FIG. 6 is a flow chart illustrating an example of a method relating to a security and/or an automation system, in accordance with various aspects of this disclosure.

FIG. 6 is a flowchart illustrating an example of a method 600 for establishing communication between a remote computing device and a home or property, in accordance with various aspects of the present disclosure. For clarity, the method 600 is described below with reference to aspects of one or more of the sensor units 110, local computing device 115, control panel 130, and/or remote computing device 135, 145 described with reference to FIGS. 1-4, and/or aspects of one or more of the apparatus 205, 205-*a*, or 205-*b* described with reference to FIGS. 2-4. In some examples, a control panel, local computing device, and/or sensor unit may execute one or more sets of codes to control the functional elements described below. Additionally or alternatively, the control panel, local computing device, and/or sensor unit may perform one or more of the functions described below using special-purpose hardware.

At block 605, method 600 may include receiving occupancy data associated with a home at a home automation system. As previously discussed, occupancy may be detected by at least one of a plurality of sensor units, control panels, or local computing devices, or a combination thereof, positioned throughout the home or property or carried on the person of the user. Occupancy may be detected by any suitable means, such as by detecting motion, sound, vibration, heartbeat or breathing, RFID, Wi-Fi, Bluetooth or other signals from a smartphone or other personal computing device, or the like.

At block 610, method 600 may include selectively detecting a first audio stream from at least one of a plurality of microphones in the home based, at least in part, on the received occupancy data. In this way, the home automation system may selectively target microphones positioned near the located occupants to ensure that communication between the at least one occupant and the operator or third party caller communicating from a remote computing device is successfully established. The plurality of microphones, as previously discussed, may be integrated with any one of a sensor unit, control panel, or local computing device, or a combination thereof.

At blocks 615, 620, and 625, method 600 may include one or more methods for receiving data from the home, where the data is used at block 630 to establish communication with the home. The methods described in blocks 615, 620, and 625 may be performed concurrently, in series, or individually, or any combination thereof.

At block 615, method 600 may include receiving alarm event data from the home at the central security operating station. The alarm event data may be received in the form of an auditory alarm detected by the plurality of microphones in the home, or may be received as a result of continuous or interval monitoring at the central security operating station of the alarm systems of the home or property. Based on this alarm event data, the central security operating station may be able to selectively establish communication with the room or area of the home that is the source of the alarm event. In other embodiments, the home automation system may automatically facilitate communication between the central security operating station and the source of the alarm event.

At block 620, method 600 may include receiving occupancy pattern data from the home. For example, pattern data may be detected indicating that the homeowner is usually in the bedroom between 11:00 pm and 6:00 am. Based on this pattern data, the home automation system may facilitate communication between the occupant and the calling operator or third party caller, by broadcasting incoming audio streams to the room most likely to contain the homeowner.

At block 625, method 600 may include receiving sound decibel level data from the home. For example, in the event of an emergency, the microphone(s) picking up the highest decibel level of noise is likely the source of the emergency event, or is at least the likely gathering place of the occupants as a result of the emergency. Even in the absence of an emergency event, those microphones picking up the highest decibel level of a sound are likely to be positioned near the sole occupant or the majority of occupants in the home or property. Based on this sound decibel level data, the home automation system may facilitate communication between the occupant(s) and the calling operator or third party caller, by broadcasting incoming audio streams to the room most likely to contain the occupant(s).

At block 630, method 600 may include selectively broadcasting a second audio stream or selectively detecting audio, or a combination thereof, based, at least in part, on the alarm event data, the occupancy pattern data, and/or the decibel level data received. Thus, as previously discussed, one- or two-way communication may be established between a caller and the at least one speaker, at least one microphone, or a combination thereof, that is most likely positioned closest to the occupant(s). This means of locating the occupants of the home may thereby improve successful communications, and may also provide useful occupant location information for emergency responders, such as police or firefighters. For example, in the event of an emergency, the home automation system or central security operating station may locate the occupants of the home based on any one or more of the above received data, and may communicate the occupants' locations to the emergency personnel to avoid wasting time coming to the occupants' aid.

In some embodiments, a lack of received sound data may also form the basis for selectively broadcasting audio to a particular location in the home or property. For example, where occupancy data is received, and an emergency event such as a fall is detected, for example by a motion or vibration sensor, the home automation system or central security operating station may attempt to gather audio data from the location in which the fall was detected. If no audio is detected, communication may be attempted to be established with the felled occupant via at least one speaker positioned near the location of the fall, and the occupant's location may be shared with emergency personnel.

Thus, the method 600 may provide for targeted communication methods relating to automation/security systems. It should be noted that the method 600 is just one implementation and that the operations of the method 600 may be rearranged or otherwise modified such that other implementations are possible.

Figure 7:
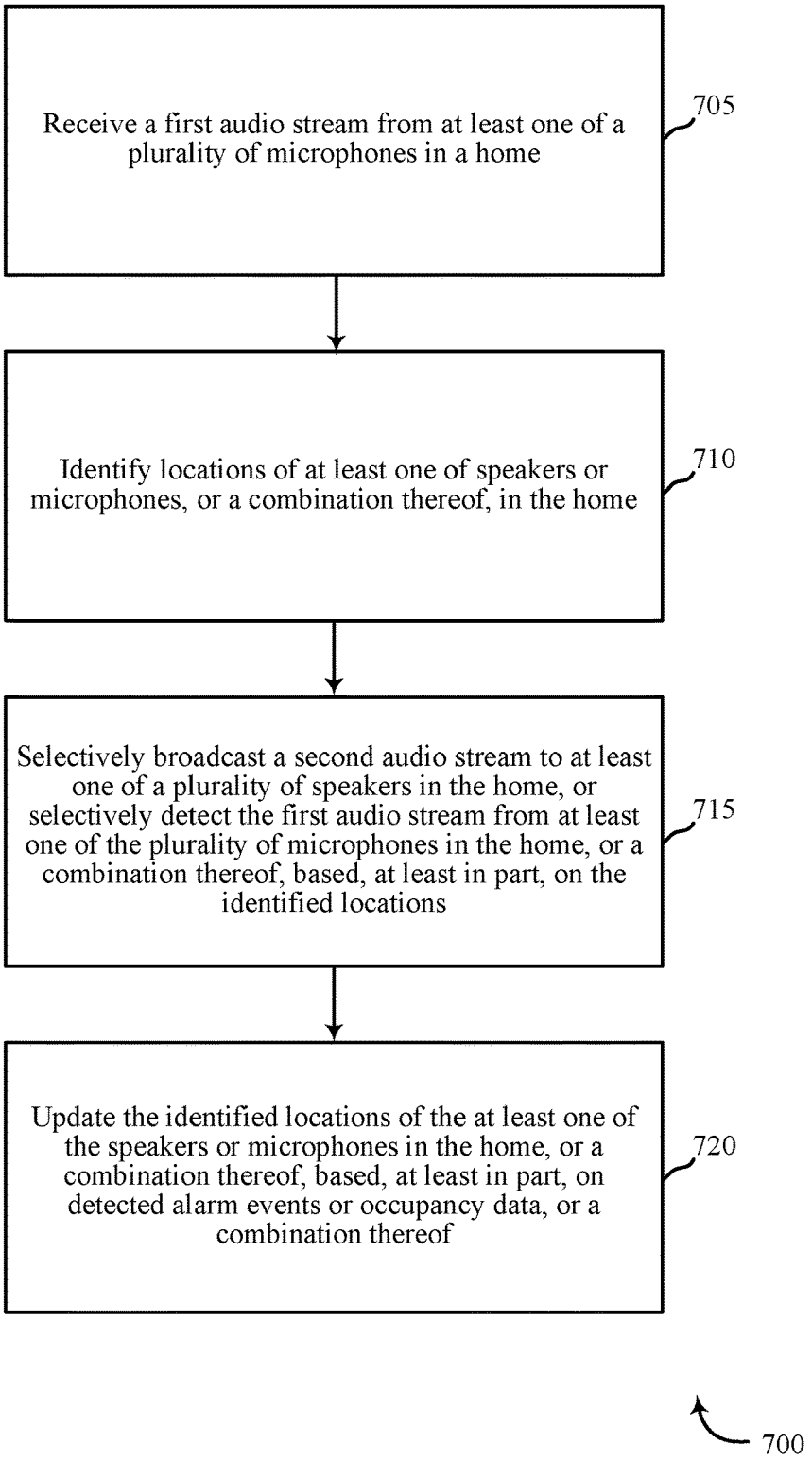
FIG. 7 is a flow chart illustrating an example of a method relating to a security and/or an automation system, in accordance with various aspects of this disclosure.

FIG. 7 is a flowchart illustrating an example of a method 700 for establishing communication between a central security operating station or third party caller and a home or property, in accordance with various aspects of the present disclosure. For clarity, the method 700 is described below with reference to aspects of one or more of the sensor units 110, local computing device 115, control panel 130, and/or remote computing device 135, 145 described with reference to FIGS. 1-4, and/or aspects of one or more of the apparatus 205, 205-*a*, or 205-*b* described with reference to FIGS. 2-4. In some examples, a control panel, local computing device, and/or sensor unit may execute one or more sets of codes to control the functional elements described below. Additionally or alternatively, the control panel, local computing device, and/or sensor unit may perform one or more of the functions described below using special-purpose hardware.

At block 705, method 700 may include receiving a first audio stream from at least one of a plurality of microphones in a home. As previously discussed, the microphones may be components of any of a sensor unit, control panel, local computing device, or a combination thereof. For example, the microphones may be a component of a smart doorbell, an interactive control panel display, and/or a security camera. The detected first audio stream may be any of a user speaking or calling for help, a triggered audio alarm, a user falling to the ground, or the like. The first audio stream may be detected by the at least one of the plurality of microphones on a continuous basis, at predetermined intervals, or at the direction of the home automation system or remote computing device.

In some embodiments, broadcasting audio, detecting audio, or a combination thereof, may be initiated based, at least in part, on receiving an alarm signal from the home. Thus, the method 700 at block 705 may only be initiated when an alarm event has been triggered. In this way, the homeowner's privacy may be maintained, where audio monitoring or communication may only be initiated in emergency situations.

At block 710, method 700 may include identifying locations of at least one of speakers or microphones, or a combination thereof, in the home. As previously discussed with regard to FIG. 4, speaker and/or microphone locations may be collocated at a single sensor unit, control panel, and/or local computing device, or may be separately positioned at various sensor units, control panels, and/or local computing devices. For example, a smart doorbell system may include a speaker unit but not a microphone unit, while a security camera system may include a microphone unit but not a speaker unit, and further still a control panel may include both a speaker unit and a microphone unit.

At block 715, method 700 may include selectively broadcasting a second audio stream to at least one of a plurality of speakers in the home, or selectively detecting audio from at least one of the plurality of microphones in the home, or a combination thereof, based, at least in part, on the identified locations. Thus, by identifying locations of each of the speakers and/or microphones, communication may be targeted at apparatuses most likely to successfully establish one- or two-way communication with the occupant(s) of the home or property.

At block 720, method 700 may include updating the identified locations of at least one of the speakers or microphones in the home, or a combination thereof, based, at least in part, on detected alarm events or occupancy data, or a combination thereof. For example, while it may be advantageous to know the location of the plurality of speakers and/or microphones in the home, successful one- or two-way communication may only be established between the occupant(s) and the central security operating station or third party caller if the targeted microphones and/or speakers are positioned closely to the occupant(s). Therefore, the identified locations of the speakers and/or microphones in the home may be updated on a continuous or predetermined interval basis in accordance with newly received alarm event and/or occupancy data. For example, an occupant in distress may be moving throughout the home, and therefore occupancy data may provide updated locations of the occupant throughout the home such that communication with the occupant at his most current location may be established. Similarly, motion-based security alarms may be triggered based on occupants moving throughout the home or property.

In other embodiments, recently updated occupancy data may not be available. For example, in a fire emergency situation, smoke may have obscured the motion or breathing sensors such that the occupant(s)'s current location cannot be determined. In this circumstance, audio broadcasts may be toggled to at least one of the plurality of speakers in the home, or audio detection may be toggled from at least one of the plurality of microphones in the home, or a combination thereof, to establish one- or two-way communication with the occupant(s). Alternatively or in addition, audio may be broadcasted and/or audio may be detected from all of the plurality of speakers and/or microphones in the home.

In some embodiments, a time stamp may be associated with the first audio stream received from at least one of the plurality of microphones in the home, and a second audio stream may be selectively broadcasted to at least one of the plurality of speakers in the home based, at least in part, on the time stamped first audio stream. In this way, one- or two-way communication may be established with the microphone and/or speaker unit positioned most closely to the occupant(s)'s last known location. Similarly, one- or two-way communication may be established with the microphone and/or speaker unit positioned most closely to the sensor unit, control panel, and/or local computing device responsible for most recently detected motion data in the home or property.

Thus, the method 700 may provide for targeted communication methods relating to automation/security systems. It should be noted that the method 700 is just one implementation and that the operations of the method 700 may be rearranged or otherwise modified such that other implementations are possible.

In some examples, aspects from two or more of the methods 500, 600, 700 may be combined and/or separated. It should be noted that the methods 500, 600, 700 are just example implementations, and that the operations of the methods 500-700 may be rearranged or otherwise modified such that other implementations are possible.

Figure 8:
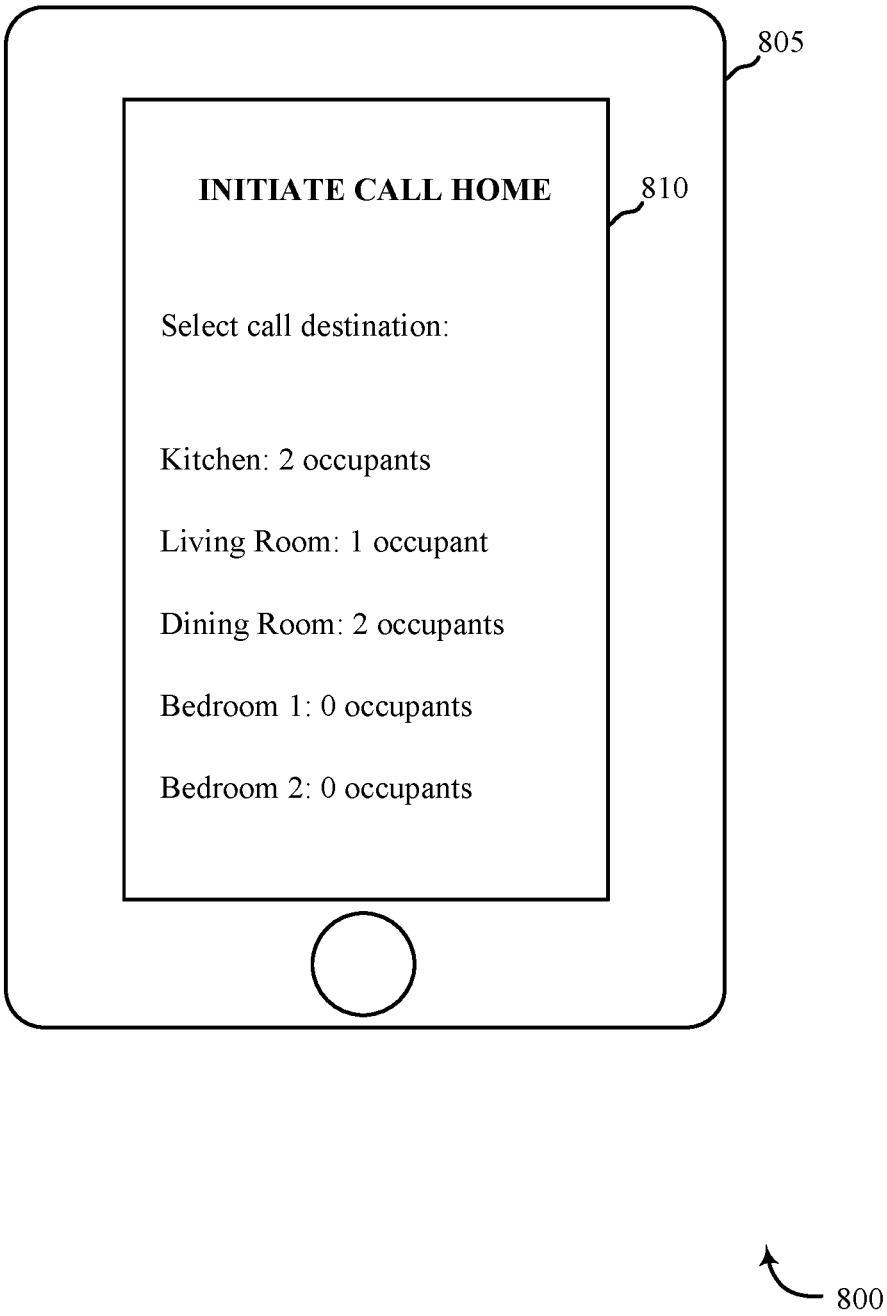
FIG. 8 is a block diagram relating to a security and/or automation system, in accordance with various aspects of this disclosure.

FIG. 8 shows a block diagram 800 of an apparatus 805 for use in establishing one- or two-way communications between a third party caller and a home automation system, in accordance with various aspects of this disclosure. The apparatus may be an example of a remote computing device as illustrated in FIG. 1, such as a smartphone, tablet, or personal computer. Where apparatus 805 is a smartphone or tablet, apparatus 805 may comprise a dedicated application operable to establish one- and two-way communications with the home automation system. Apparatus 805 may comprise a display screen 810, which may display information related to establishing communication with the home. In the illustrated example, occupancy data detected by one or more sensor units in the home may be communicated, for example via a network and server, to the apparatus 805. The detected occupancy data may be displayed on the display screen 810 of apparatus 805, such that the third party caller may be notified of the location of occupants in the home. For example, in FIG. 8, the one or more sensor units have detected, for example via motion, audio, vibration, heat, heartbeat, or respiratory sensors, or the like, that there are two occupants in the kitchen, one occupant in the living room, two occupants in the dining room, and no occupants in either the first or second bedrooms. In some embodiments, the one or more sensor units may additionally use facial recognition technology to identify the particular occupants in the home, and may provide this occupant identity information to the third party caller, for example indicating that Bob and Susan are in the kitchen, Mary is in the living room, and Tommy and Charlie are in the dining room.

Based on the received occupancy data, the third party caller may selectively broadcast his audio communication to one or more speaker systems in the home. In some embodiments, the display screen 810 may display the locations of the speaker systems in the home, for example in the form of a floor plan of the home or a list. In other embodiments, the third party caller may indicate the intended recipient(s) of his communication, and the home automation system may automatically broadcast the received communication from the third party caller to the speaker system(s) positioned closest to the intended recipients. In some embodiments, the third party caller may broadcast his audio communication to all operable speaker systems in the home.

In one embodiment, occupancy data may be continuously updated on the display screen 810, for example as one occupant moves from the living room to the kitchen, such that the third party caller may stay apprised of the locations of the intended recipients of his call.

In some embodiments, one or more sensor units, control panels, or local computing devices may receive a communication request from an outside caller, and may provide permission to receive the call. For example, a light may appear on a control panel or sensor unit, or a chime may sound, notifying the occupants of the home that an outside caller is attempting to initiate a one- or two-way communication with the occupants. In other embodiments, a message may appear on the display of a control panel or local computing device requesting confirmation that the communication may be initiated. The occupant(s) may accordingly accept or deny the incoming communication, such that privacy of the occupants is properly preserved.

Although described as audio communications, any of the received or broadcasted communications between the home automation system and the remote computing devices may also include video communications as well. Thus, operators at central security operating stations, or third party callers calling from, for example, a smartphone, may initiate one- and two-way video communications with occupants of the home.

The detailed description set forth above in connection with the appended drawings describes examples and does not represent the only instances that may be implemented or that are within the scope of the claims. The terms "example" and "exemplary," when used in this description, mean "serving as an example, instance, or illustration," and not "preferred" or "advantageous over other examples." The detailed description includes specific details for the purpose of providing an understanding of the described techniques. These techniques, however, may be practiced without these specific details. In some instances, known structures and apparatuses are shown in block diagram form in order to avoid obscuring the concepts of the described examples.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and components described in connection with this disclosure may be implemented or performed with a general-purpose processor, a digital signal processor (DSP), an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, and/or state machine. A processor may also be implemented as a combination of computing devices, e.g., a combination of a DSP and a microprocessor, multiple microprocessors, one or more microprocessors in conjunction with a DSP core, and/or any other such configuration.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope and spirit of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

As used herein, including in the claims, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

In addition, any disclosure of components contained within other components or separate from other components should be considered exemplary because multiple other architectures may potentially be implemented to achieve the same functionality, including incorporating all, most, and/or some elements as part of one or more unitary structures and/or separate structures.

Computer-readable media includes both computer storage media and communication media including any medium that facilitates transfer of a computer program from one place to another. A storage medium may be any available medium that can be accessed by a general purpose or special purpose computer. By way of example, and not limitation, computer-readable media can comprise RAM, ROM, EEPROM, flash memory, CD-ROM, DVD, or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the broadest scope consistent with the principles and novel features disclosed.

This disclosure may specifically apply to security system applications. This disclosure may specifically apply to automation system applications. In some embodiments, the concepts, the technical descriptions, the features, the methods, the ideas, and/or the descriptions may specifically apply to security and/or automation system applications. Distinct advantages of such systems for these specific applications are apparent from this disclosure.

The process parameters, actions, and steps described and/or illustrated in this disclosure are given by way of example only and can be varied as desired. For example, while the steps illustrated and/or described may be shown or discussed in a particular order, these steps do not necessarily need to be performed in the order illustrated or discussed. The various exemplary methods described and/or illustrated here may also omit one or more of the steps described or illustrated here or include additional steps in addition to those disclosed.

Furthermore, while various embodiments have been described and/or illustrated here in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments these software modules may permit and/or instruct a computing system to perform one or more of the exemplary embodiments disclosed here.

This description, for purposes of explanation, has been described with reference to specific embodiments. The illustrative discussions above, however, are not intended to be exhaustive or limit the present systems and methods to the precise forms discussed. Many modifications and variations are possible in view of the above teachings. The embodiments were chosen and described in order to explain the principles of the present systems and methods and their practical applications, to enable others skilled in the art to utilize the present systems, apparatus, and methods and various embodiments with various modifications as may be suited to the particular use contemplated.

What is claimed is:

1. A method for home automation communication systems, comprising:

receiving a communication from a remote device, wherein the communication comprises data information and an indication of an intended recipient;

determining an occupancy of a sub-region of a premises based at least in part on data received from a sensor;

identifying an occupant of the occupancy of the sub-region based at least in part on the data received from the sensor, wherein the identifying comprises determining the occupant is the intended recipient of the communication; and transmitting the communication to a local device of the sub-region of the premises based at least in part on the occupant of the occupancy of the sub-region being the intended recipient of the communication.

2. The method of claim 1, further comprising:

providing a notification about the communication to the occupant via the local device; and receiving feedback associated with the communication from the occupant in response to the notification, wherein transmitting the communication to the local device of the sub-region is based at least in part on the feedback.

3. The method of claim 2, further comprising:

establishing a connection between the local device of the sub-region and the remote device based at least in part on the feedback, wherein the connection is a two-way communication.

4. The method of claim 3, further comprising:

receiving a second communication from the local device; and transmitting the second communication to the remote device based at least in part on the established connection.

5. The method of claim 1, further comprising:

receiving alarm event data from the sensor of the premises, wherein transmitting the communication is based at least in part on the alarm event data.

6. The method of claim 1, further comprising:

toggling the transmitting of the communication to a plurality of local devices of the premises based at least in part on an availability of each local device of the plurality.

7. The method of claim 1, further comprising:

assigning a time stamp to occupancy data associated with the occupancy of the sub-region of the premises, wherein transmitting the communication to the local device of the sub-region is based at least in part on the time stamp.

8. The method of claim 1, wherein the remote device is located at a location different from the premises.

9. The method of claim 1, wherein the local device comprise a component of a home security system, a smart home system, a doorbell, a door camera, a thermostat, a control panel, a sensor, a smoke detector, or a mobile robotic device, or a combination thereof.

10. The method of claim 1, wherein the local device comprises a speaker, a microphone, a camera, or a display, or a combination thereof.

11. The method of claim 1, wherein the communication comprises an audio communication, a video communication, or both.

12. An apparatus for home automation communication systems comprising:

a processor;

memory in electronic communicaiton with the processor; and instructions stored in the memory and operable, when executed by the processor, to cause the apparatus to:

receive a communication from a remote device, wherein the communication comprises data information and an indication of an intended recipient;

determine an occupancy of a sub-region of a premises based at least in part on received data from a sensor;

identify an occupant of the occupancy of the sub-region based at least in part on the data received from the sensor, wherein the identifying comprises determining the occupant is the intended recipient of the communication; and transmit the communication to a local device of the sub-region of the premises based at least in part on the occupant of the occupancy of the sub-region being the intended recipient of the communication.

13. The apparatus of claim 12, wherein the instructions are further executable by the processor to:

provide a notification to the occupant of the communication via the local device of the sub-region; and receive feedback associated with the communication from the occupant, wherein transmitting the communication to the local device of the sub-region is based at least in part on the feedback.

14. The apparatus of claim 13, wherein the instructions are further executable by the processor to:

establish a connection between the local device of the sub-region and the remote device based at least in part on the feedback, wherein the connection is a two-way communication.

15. The apparatus of claim 12, wherein the local device comprises a speaker, a microphone, a camera, or a display, or a combination thereof.

16. The apparatus of claim 12, wherein the communication comprises an audio communication or a video communication, or both.

17. A non-transitory computer readable medium stroing code for home automation communication systems, the code comprising instructions executable by a processor to:

receive a communication from a remote device, wherein the communication comprises data information and an indication of an intended recipient;

determine an occupancy of a sub-region of a premises based at least in part on received data from a sensor;

identify an occupant of the occupancy of the sub-region based at least in part on the data received from the sensor, wherein the identifying comprises determining the occupant is the intended recipient of the communication; and broadcast the communication to a local device of the sub-region of the premises based at least in part on the occupant of the occupancy of the sub-region being the intended recipient of the communication.

18. The non-transitory computer readable medium of claim 17, wherein the instructions are further executable by the processor to:

provide a notification to the occupant of the communication via the local device of the sub-region; and receive feedback associated with the communication from the occupant, wherein transmitting the communication to the local device of the sub-region is based at least in part on the feedback.

* * * * *